United States Patent [19]

Correa

[11] Patent Number: 4,833,744

[45] Date of Patent: May 30, 1989

[54] FITTED SHEET AND SHEET-HOLDING FIXTURE FOR A WATERBED

[76] Inventor: David I. Correa, 85 Palamino Cir., Boca Raton, Fla. 33487

[21] Appl. No.: 220,745

[22] Filed: Jul. 18, 1988

[51] Int. Cl.[4] ..... A47G 9/04

[52] U.S. Cl. ..... 5/496; 5/497; 5/498; 24/72.5

[58] Field of Search ..... 5/494, 496, 499; 24/72.5

[56] References Cited

U.S. PATENT DOCUMENTS

| | | | |
|---|---|---|---|
| 3,066,321 | 12/1962 | Kintner | 5/498 |
| 3,996,633 | 12/1976 | Burke | 5/497 |
| 4,040,133 | 8/1977 | Gilreath | 24/72.5 X |
| 4,539,723 | 9/1985 | Hillsberry | 24/72.5 X |
| 4,712,262 | 12/1987 | Viggiano | 24/72.5 X |

FOREIGN PATENT DOCUMENTS

| | | | |
|---|---|---|---|
| 202300 | 8/1958 | Austria | 5/498 |

*Primary Examiner*—Gary L. Smith
*Assistant Examiner*—Michael F. Trettel
*Attorney, Agent, or Firm*—John H. Faro

[57] ABSTRACT

A novel fitted sheet and a novel rigid fixture for holding a corner of the novel sheet in place on a rectangular waterbed mattress. A fixture is positioned adjacent each corner of the mattress with a base portion under the mattress, an upstanding corner portion having a back side against the corner of the mattress and a face side having a fastener member attached thereto, and a spacing portion spacing the face side from the corner of the frame that holds the waterbed mattress. The novel fitted sheet has a mating fastener member on the inside surface of each of its corners. In combination, the novel sheet fits over the mattress and the corner portions of the four (4) fixtures with the fastener members fastened together, holding the novel sheet in place. Because the corners of the mattress are spaced away from the frame, the mattress does not have to be lifted or otherwise manipulated to position the sheet on, or remove the sheet from, the mattress. The novel fitted sheet may include a loop or tab attached to the edge of each of its corners.

12 Claims, 1 Drawing Sheet

FITTED SHEET AND SHEET-HOLDING FIXTURE FOR A WATERBED

BACKGROUND OF THE INVENTION

1. Field of the Invention

This invention relates to a novel fitted sheet for a waterbed and to a novel fixture for holding the novel sheet in place on the waterbed. The invention includes also the combination of the novel sheet and four (4) novel fixtures with a waterbed mattress in a supporting frame.

2. Description of the Prior Art

The most common type of waterbed includes a mattress comprising a water-filled bladder and a substantially-rectangular frame which confines the bottom and sides of the mattress. A liner is usually present between the frame and the mattress to catch any liquid that may leak from the bladder. Sheets and other bedding are positioned over the mattress prior to their use. Because of the resiliency of the waterbed mattress and the movements of the mattress when the bed is in use, the bedding does not remain in place as with stuffed or innerspring mattresses. Also, because of the considerable weight of the waterbed mattress and substantial pressure of the mattress pressing against the sides of the frame, it is considerably more difficult to tuck the bedding along the sides and under the mattress.

Various attempts have been made to overcome the problems associated with changing the bedding, with making up the beds, and with retaining the bedding in place on a waterbed mattress. U.S. Pat. Nos. 4,089,075 to M. I. May and 4,389,741 to L. D. Larson, each provides fixtures that attach to the inside of the frame, which fixtures clamp the bedding to the frame. While this approach holds the bedding in place, changing the bedding and making up the bed after use is inconvenient. Also, although it is not necessary to lift the waterbed mattress, it is inconvenient to apply the clamps to the bedding, especially in view of the substantial pressure of the mattress against the sides of the frame.

U.S. Pat. No. 44,521,970 to J. M. Jester, provides four (4) anchors under the waterbed mattress that are held by the weight of the mattress. An anchor is attached to each corner of a sheet under the mattress, thereby holding the sheet in place. Lifting the weight of the mattress and pushing against the side pressure of the mattress makes changing the bedding and making up the waterbed difficult and inconvenient.

U.S. Pat. No. 44,301,561 to M. McLeod, provides continuous hook-and-loop fasteners along the margins of the liner on both the inside and outside thereof. A bed pad has its margins fastened along the inside margins of the liner, and a flat bottom sheet has its margins fastened along the outside margins of the liner. A flat top sheet is sewn to the bottom sheet along the margins of the foot portions thereof. This arrangement requires considerable time and effort to fasten and unfasten all of the margins of the bottom sheet to and from the liner against the considerable sideward pressure of the mattress pressing against the side of the frame.

U.S. Pat. No. 44,040,133 to M. B. Gilreath provides four (4) straps that are held by the weight of the mattress and extend upward adjacent to each of the mattress corners. The straps have hook-and-loop fasteners on both sides along the extended margins of the straps. Each of the four corners of a bed pad attach to the inner fasteners of the strap. Each of the four corners of a flat bottom-sheet attach to the outer fasteners. Each of the two corners at the foot of a flat top-sheet attach to the two corners at the foot of the bottom-sheet with hook-and-loop fasteners. This arrangement requires considerable effort to position the straps under the mattress, and also to fasten and unfasten the sheets against the considerable sideward pressure of the mattress against the sides of the frame.

OBJECTS OF THE INVENTION

An object of this invention is to provide a novel fitted sheet and a novel sheet-holding fixture for use with a waterbed.

Another object of this invention is to provide a novel sheet-holding fixture and a novel fitted sheet therefor which does not require the waterbed mattress to be lifted or the corners of the mattress pressed away from its frame when the bedding is changed or when the beds are made up after use.

A further object of this invention is to provide a novel sheet-holding fixture and a novel fitted sheet therefor with the foregoing advantages and, additionally, are simple in construction and relatively low in cost to fabricate.

A further object of this invention is to provide a novel sheet-holding fixture and a novel fitted sheet to be used therewith having the foregoing characteristics and which further is fully compatible for use with presently available waterbeds, as well as those previously purchased.

SUMMARY OF THE INVENTION

The foregoing and other objects can be achieved with the present invention which includes a novel fitted sheet and a novel rigid fixture for holding a corner of the novel sheet in place on a substantially rectangular waterbed mattress. The waterbed mattress is of ordinary design supported in a frame which confines the bottom and sides of the mattress.

The novel fixture is a single, integral, rigid piece comprising a base portion which is adapted to be captured and held by the weight of the mattress between the mattress and the frame, a corner portion upstanding from the base portion and having a face side and a back side adapted to bear against a corner of the mattress, one member of a fastener pair attached to the face side of the corner portion, and a spacing portion for spacing the face side of the corner portion from a corner of the frame providing adequate access to the novel fixture.

In use, one fixture is positioned against each of the four corners of the waterbed mattress with its base portion underneath the mattress and the upstanding portion against the corner of the mattress. In this position, the face side of the corner portion is spaced from the frame, providing adequate access between the corner portion of the fixture and the corner of the frame. The novel fitted sheet has four (4) formed sheet corners and is adapted in size to fit over the waterbed mattress and the corner portions of the fixtures. Each sheet corner has attached thereto, on the inner surface thereof, the other fastener member of said fastener pair, located to fasten to the outer surface of the one fastener member on the fixture. A tab or loop of material may be attached to each sheet corner, so positioned at each corner that it can be grasped manually for quick and easy detachment of the fastener pairs and removal of the sheet from each fixture.

In use, with four of the novel fixtures in place adjacent to each of the corners of a waterbed mattress, the novel fitted sheet need only be spread over the mattress and each sheet corner pulled over the corner portion of each fixture and the fastener members fastened together. Since the corner portions of the fixture are spaced from the bed frame, it is not necessary to lift the mattress, or to push the side of the mattress away from the side of the frame, Yet, the fastener pairs hold the novel fitted sheet firmly in place. Also, the fastener pairs are small and little effort is involved in fastening and unfastening the fitted sheet. Thereby, changing the sheet and making up the bedding after each use of the bed, is greatly simplified, reducing the time and effort required.

Since the novel fixtures are rigid and are adapted to fit the corners of the mattress, they need only be positioned between frame and the mattress once. In a preferred embodiment, the spacing portion of the fixture bears against the corner of the mattress, thereby holding the fixture firmly in place while the waterbed is being used.

The novel combination may include a flat top sheet and a mattress pad with the bedding. The top sheet may be sewn along the margin of the foot of the top sheet to the margin of the foot of the fitted sheet. Instead of being sewn to the fitted sheet, the flat top sheet may be held to the fitted sheet with a detachable fastener pair. The mattress pad may have tabs with detachable fasteners extending from each of the pad corners adapted to attach to the central portion of the fastener member on each fixture.

DETAILED DESCRIPTION OF THE INVENTION INCLUDING THE PREFERRED EMBODIMENTS

Figure 1:
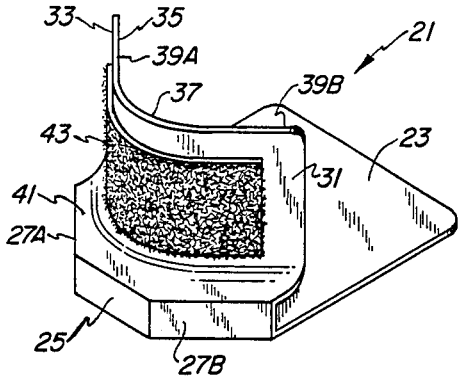
FIG. 1 is a perspective view of a preferred embodiment of the novel sheet-holding fixture of the invention.

The following description of some of the preferred embodiments of the concepts of this invention is made in reference to the accompanying figures. Where an individual structural element is depicted in more than one figure, it is assigned a common reference numeral for simplification of identification and understanding.

Figure 3:
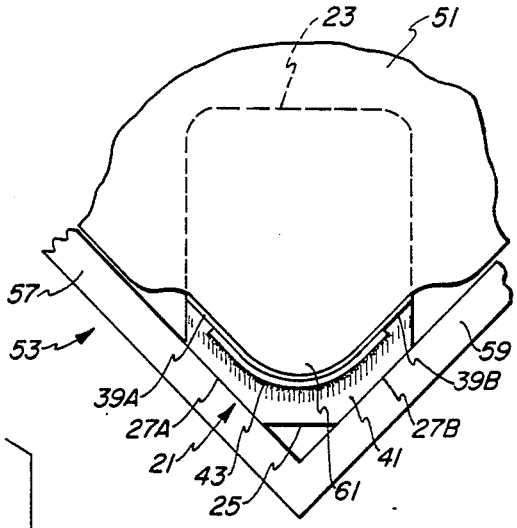
FIG. 3 is a plan view of the broken-away portion of the novel combination shown in FIG. 2, without the fitted sheet thereon.
Figure 2:
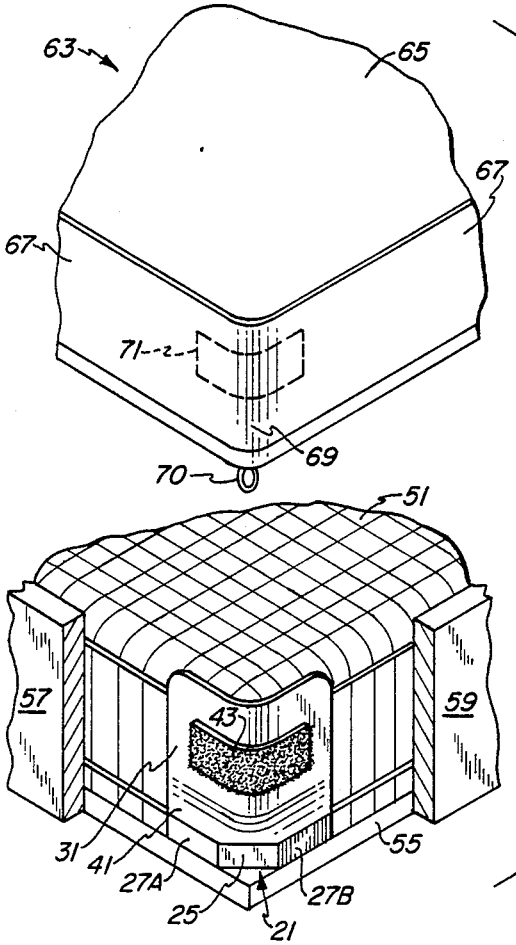
FIG. 2 is an exploded perspective view of a broken-away corner portion of a preferred embodiment of the novel combination including a waterbed, the novel fixture shown in FIG. 1, and a novel fitted sheet.

FIGS. 1, 2 and 3 show a preferred embodiment of a novel fixture (21). The fixture (21) includes a planar base portion (23) adapted by its planar shape to fit between a waterbed mattress and the bottom of its supporting frame. This base portion (23) has a width of about 6 inches (15.2 cm), an overall length of about 8 inches (20.32 cm) and a substantially uniform thickness of about ⅛ inch (0.32 cm). One end of the base portion (23) has its corners truncated at about 45 degrees to provide a center edge and two adjacent edges, from which rise integral short walls (25), (27A) and (27B) respectively, about one inch (2.54 cm) high. The two adjacent short walls (27A) and (27B) are angled about 90 degrees from one another and are connected by the center short wall (25) which is about 45 degrees from each of the adjacent short walls (27A) and (27B).

The fixture (21) also includes an upstanding planar corner portion (31) of substantially uniform thickness having a face side (33) and a back side (35) as shown in FIG. 1. The corner portion is shaped to a quarter round shape with about a 2-inch (5.1 cm) radius at the center part (37) and flat end parts (39A) and (39B). The corner portion (31) is connected to the short walls (25), (27A) and (27B) of the base portion (23) by a spacing portion (41) which is integral with both the base portion (23) and the corner portion (31). The spacing portion (41) is at an angle of about 45 degrees to the base portion and offsets the corner portion (31) away from the short walls (25), (27A) and (27B) as viewed from above as shown in FIG. 3.

A hook fastener member (43) of a hook-and-loop fastener pair is adhered to about the middle of the face side (33) of the corner portion (31). Hook-and-loop fasteners are available commercially under the tradename VELCRO.

FIGS. 2 and 3 show the fixture (21) positioned in a portion of a waterbed. The waterbed includes a waterbed mattress comprising a water-filled bladder (51) supported in a frame (53) comprising a bottom panel (55) and side panels (57) and (59), which confine the bottom and sides of the bladder (51), and form a corner of the waterbed. The base portion (23) of the fixture (21) fits between the bottom panel (55) of the frame and the bottom of the bladder (51). The two adjacent short walls (27A) and (27B) bear against the side panels (57) and (59) respectively, adjacent to the bottom panel (55). The back side (35) of the corner portion (31) confines the bladder corner (61) of the bladder (51), and holds the bladder corner (61) away from the frame corner by about one inch (2.54 cm). The overall height of the fixture (21) is slightly less than the height of the side panels (57) and (59).

FIG. 2 shows a portion of a novel fitted sheet (63) comprising a central sheet part (65), four side sheet parts (63) and four sheet corners (69). Each corner (69) is formed and defined by the central sheet part (65) and two side sheet parts (67). The fitted sheet (63) fits over the bladder (51) and the face side (33) of the corner portion (31) of the fixture in each corner. There is a loop fastener member (71) of a hook-and-loop fastener pair adhered to or sewn into the inside of each sheet corner (69) in such position as to be opposite the hook fastener member (43) and be fastenable to it. Also, a tab or loop (70) of fabric material is attached to the edge of each sheet corner (69). The tab or loop (70) is so positioned at each corner that it can be grasped manually by a user for quick and easy detachment of the fastener pair and removal of the sheet from each fixture.

Although FIG. 2 shows the fitted sheet (63) exploded away from the bladder (51) for purposes of this description, in fact, the fitted sheet (63) is over the bladder (51) with the two fastener members (43) and (71) fastened to one another in each mattress corner. As compared to prior arrangements, it is easier to make up a waterbed with the novel fixture because the bladder corners are held away from the frame. The fitted corners of the novel sheet can be slipped over the fixtures manually with ease, without having to push the bladder away from the frame. The corner fasteners hold the corners of the fitted sheet, and therefore, the entire sheet is held firmly in place. The fitted sheet does not tuck under the mattress and is not clamped to the side panels of the frame. Similarly, the fitted sheet can be removed manually without pushing the bladder away from the frame.

Figure 4:
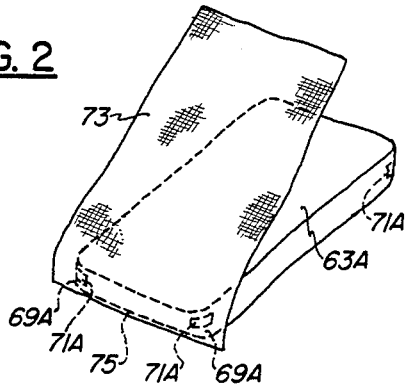
FIG. 4 is a perspective view of a novel fitted bottom sheet having a flat top sheet sewn thereto at the foot portion thereof.

If it is desired to have both a bottom sheet and a top sheet, a flat top sheet can be sewn or otherwise attached to a fitted bottom sheet as described above along the foot portion thereof. FIG. 4 shows a preferred combination of a flat top sheet (73) sewn along the margin of the dedicated foot end thereof to the margin of the dedicated foot end of a fitted bottom sheet (63A) with stitching (75). The bottom sheet (63A) has fitted corners (69A) and the loop fastener member (71A) of a hook-and-loop fastener pair on the inside surface of each corner (69A).

A mattress pad (not shown) under the bottom-sheet may be included with the bedding. A mattress pad under the novel fitted sheet holds its position on the bed by friction. If it is desired to hold the mattress pad more positively, the corners of the pad may be provided with narrow tabs having fastener members which fasten to the central part of the fastener members on the novel fixtures. In use, the pad can be positioned on the mattress and the pad tabs fastened to the central parts of the fixture fasteners. Then, the bottom-sheet can be positioned over the pad and the sheet fasteners applied over the pad tabs and fastened on each side thereof to the fixture fasteners.

The novel fixtures may be made of an organic polymeric material. A plastic such as a polystyrene could be used. Polystyrenes are commercially-available in a variety of colors and other physical characteristics, are reasonably priced, and can be formed by economical injection-molding processes. Preferably, the novel fixture is molded as a single integral piece with the fastener member later attached with adhesive. However, the fixture can be molded in parts and the parts welded together to form an integral piece to which the fastener member is later attached. The novel sheet may be made of sheet material ordinarily used for bedding. All cotton or cotton-and-polyester blends can be used. The fitted corners of the novel sheet can be formed from a single rectangular piece of sheeting material by notching the corners of the piece and then sewing together the edges of the notches.

The novel fixture is revolutionary, state of the art fastener which, when used with a novel fitted waterbed sheet, makes changing waterbed sheets as easy as changing ordinary convention bed sheets.

The novel fixture reduces the back-breaking task of changing, or tucking, waterbed sheets to one of little toil. This is accomplished by eliminating the need to physically lift each corner of the water filled bladder in order to secure the sheets underneath. Due to the nature of waterbeds and human sleeping patterns (i.e. tossing and turning), this task could be required every morning without the use of a set of the novel fixtures.

This novel fixture is also attractive for children, elderly or physically impaired individuals who, up to now, were reluctant to utilize a waterbed because of the difficulty involved in changing the sheets. This difficulty is greatly reduced by using the novel fixture along with the novel fitted sheet.

The foregoing figures and descriptions thereof are provided as illustrative of some of the preferred embodiments of the concepts of this invention. While these embodiments represent what is regarded as the best modes for practicing this invention, they are not intended as delineating the scope of the invention, which is set forth in the claims.

What is claimed is:

1. A substantially rigid fixture for holding a corner of a fitted sheet in place on a substantially rectangular waterbed mattress, said mattress being supported in a frame that confines the bottom and sides of said mattress, said fixture comprising:

a base portion adapted to be captured between the bottom of said mattress and said frame, a corner portion upstanding from said base portion and having a face side and a back side, said back side being adapted to bear against a corner of said mattress, one fastener member of a pair of interengaging fastener members attached to said face side of said corner portion, and a spacing portion for spacing the face side of said corner portion from said frame, said base portion, said corner portion and said spacing portion being integral in a single piece of plastic material, and wherein said corner portion is substantially perpendicular to said base portion and said spacing portion joins said base portion to said corner portion.

2. The fixture defined in claim 1, wherein said base portion has a front surface adapted to bear against an inner corner of said frame.

3. The fixture defined in claim 2, wherein said base portion, said spacing portion and said corner portion are constituted of a single piece of molded organic polymeric polystyrene material.

4. The fixture defined in claim 2, wherein said base portion, said spacing portion and said corner portion are constituted in a single piece of plastic material of substantially uniform thickness and shaped to perform said functions.

5. The fixture defined in claim 4, wherein said one member of said fastener pair is the hook member of a hook-and-loop fastener pair.

6. A fitted sheet adapted for use with a substantially rectangular waterbed mattress supported in a frame and a fixture as defined in claim 1 positioned in each corner between said mattress and said frame, said sheet having four formed sheet corners, a loop or tab attached to the edge of each of said sheet corners, each sheet corner having an outer frame side and an inner mattress side, each mattress side having attached thereto the other fastener member of said pair of interengaging fastener members and located to fasten to said one fastener member when said sheet corner is positioned over said fixture.

7. The fitted sheet defined in claim 6, wherein said other fastener member is the loop member of a hook-and-loop fastener pair.

8. The fitted sheet defined in claim 6, having a dedicated head end and a dedicated foot end, and including a flat sheet sewn at a margin thereof to the margin of said foot end of said fitted sheet.

9. In combination, (A) a substantially rectangular waterbed mattress, (B) in a substantially rectangular supporting frame confining the bottom and sides of said mattress, (C) a rigid fixture between each corner of said mattress and each corner of said frame; each of said fixtures comprising a base portion captured between the bottom of said mattress and the bottom of said frame, a corner portion upstanding from said base portion and having a face side and a back side, said back side bearing against a corner of said mattress, one member of a pair of interengaging fastener members attached to the face side of said corner portion and a spacing portion spacing said face side from said frame, and (D) a fitted sheet over said mattress and said fixtures, said sheet having four formed sheet corners mated with the four corner portions of said fixtures, a loop or tab attached to the edge of each of said sheet corners, each sheet corner having the other fastener member of said fastener pair attached thereto and positioned over said fixture with said fastener members fastened to one another.

10. The combination defined in claim 9, wherein said fastener pairs are hook-and-loop fastener pairs.

11. The combination defined in claim 9, wherein each of said one fastener members is the hook member and each of said other fastener members is the loop member of a hook-and-loop fastener pair.

12. The combination defined in claim 9, wherein said fitted sheet has a dedicated head end and a dedicated foot end, and said combination includes a flat sheet sewn at a margin thereof to the margin of said foot end of said fitted sheet.

* * * * *